US011745329B2

(12) United States Patent
Hyma et al.

(10) Patent No.: US 11,745,329 B2
(45) **Date of Patent: *Sep. 5, 2023**

(54) WRENCH CASE

(71) Applicant: Milwaukee Electric Tool Corporation, Brookfield, WI (US)

(72) Inventors: Steven W. Hyma, Milwaukee, WI (US); Joseph M. DeBaker, Greenfield, WI (US); Scott M. Hangartner, Hartland, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/355,931

(22) Filed: Jun. 23, 2021

(65) Prior Publication Data

US 2021/0316442 A1 Oct. 14, 2021

Related U.S. Application Data

(63) Continuation of application No. 16/521,329, filed on Jul. 24, 2019, now Pat. No. 11,065,758, which is a (Continued)

(51) Int. Cl.

| | |
|---|---|
| ***B25H 3/02*** | (2006.01) |
| ***B25H 3/00*** | (2006.01) |
| ***B25B 13/56*** | (2006.01) |

(52) U.S. Cl.

CPC ..... *B25H 3/023* (2013.01); *B25B 13/56* (2013.01); *B25H 3/00* (2013.01); *B25H 3/006* (2013.01)

(58) Field of Classification Search

CPC ..... B25H 3/023; B25H 3/006; B25H 3/00; B25B 13/56

(Continued)

(56) References Cited

U.S. PATENT DOCUMENTS 4,179,040 A * 12/1979 Bateman ..... A47J 47/02 220/660

4,911,297 A 3/1990 Suburu (Continued)

FOREIGN PATENT DOCUMENTS

| | | |
|---|---|---|
| CN | 2292003 | 9/1998 |
| CN | 2334552 | 8/1999 |

(Continued)

OTHER PUBLICATIONS

International Search Report and Written Opinion for International Application No. PCT/US2018/015351, dated Jul. 18, 2018, 14 pages.

*Primary Examiner* — Rafael A Ortiz
*Assistant Examiner* — Sanjidul Islam
(74) *Attorney, Agent, or Firm* — Reinhart Boerner Van Deuren s.c.

(57) ABSTRACT

A wrench case for a set of combination wrenches, where each wrench includes an open end, a closed end, and an elongate handle extending therebetween. The wrench case includes a handle, a post receiving the open end of each wrench, and a body including a front side and a back side. The front side supports the elongate handle of each wrench. The wrench case further includes a plurality of tabs spaced apart along the front side of the body. Between adjacent tabs is a gap that receives each wrench. The wrench case further includes a door pivotally coupled to the body between a closed position, in which the door is coupled adjacent the front side of the body to maintain each wrench against the body, and an open position, in which the door is coupled adjacent the back side of the body.

18 Claims, 5 Drawing Sheets

Related U.S. Application Data continuation of application No. PCT/US2018/015351, filed on Jan. 26, 2018.

(60) Provisional application No. 62/451,217, filed on Jan. 27, 2017.

(58) Field of Classification Search
USPC ..... 206/349, 372, 373, 376, 378
See application file for complete search history.

(56) References Cited

U.S. PATENT DOCUMENTS

| | | | | |
|---|---|---|---|---|
| 5,598,924 | A | 2/1997 | McCann | |
| 5,638,964 | A | 6/1997 | Ernst | |
| D412,617 | S | 8/1999 | Kopala, Jr. | |
| 5,931,299 | A | 8/1999 | Hsieh | |
| D433,613 | S | 11/2000 | Jialin | |
| 6,315,121 | B1 | 11/2001 | Hansen | |
| 6,857,527 | B2 | 2/2005 | Hu | |
| 7,080,733 | B2 | 7/2006 | Kao | |
| D541,612 | S | 5/2007 | Lin et al. | |
| 7,537,124 | B2 | 5/2009 | Chen | |
| 7,584,845 | B2 | 9/2009 | Cheng | |
| 7,987,975 | B1 | 8/2011 | Lee | |
| 7,987,981 | B1 | 8/2011 | Lee | |
| 8,038,020 | B2 | 10/2011 | Vecchio et al. | |
| D652,280 | S | 1/2012 | Huang | |
| 8,261,911 | B2 | 9/2012 | Lee | |
| 8,403,155 | B1 | 3/2013 | Kao | |
| 8,408,388 | B1 | 4/2013 | Chen | |
| D710,668 | S | 8/2014 | Wu | |
| D734,612 | S | 7/2015 | Liu | |
| 2002/0070185 | A1 | 6/2002 | Chen | |
| 2003/0016993 | A1* | 1/2003 | Chen | B25H 3/003 403/329 |
| 2004/0000497 | A1 | 1/2004 | Huang | |
| 2005/0082323 | A1 | 4/2005 | O'Hair | |
| 2006/0118500 | A1 | 6/2006 | Chen | |
| 2010/0065522 | A1* | 3/2010 | Cheng | B25H 3/04 211/85.8 |
| 2010/0258465 | A1* | 10/2010 | Gomas | B25H 3/003 81/176.1 |
| 2012/0138497 | A1 | 6/2012 | Lee | |
| 2014/0231307 | A1* | 8/2014 | Wen | B25H 3/02 206/736 |
| 2016/0121478 | A1 | 5/2016 | Schein et al. | |

FOREIGN PATENT DOCUMENTS

| | | | |
|---|---|---|---|
| CN | 201720838 | U | 1/2011 |
| CN | 203185319 | U | 9/2013 |
| CN | 203799333 | U | 8/2014 |
| CN | 205614630 | | 10/2016 |
| CN | 106312896 | A | 1/2017 |
| DE | 202010008854 | | 3/2011 |
| DE | 202010013102 | | 3/2011 |
| DE | 202011000052 | | 4/2011 |
| DE | 102011056947 | | 11/2014 |
| FR | 2996159 | | 2/2015 |
| TW | 376010 | | 12/1991 |
| TW | 284657 | | 8/1996 |
| TW | 293746 | | 12/1996 |
| TW | 446514 | | 7/2001 |
| TW | 200918261 | | 5/2009 |
| TW | 200932451 | A | 8/2009 |
| TW | 200944342 | A | 11/2009 |
| TW | M424220 | | 3/2012 |
| TW | I374076 | | 10/2012 |
| TW | I374077 | | 10/2012 |
| TW | I374078 | | 10/2012 |
| WO | WO0009421 | | 2/2000 |

* cited by examiner

WRENCH CASE

CROSS-REFERENCE TO RELATED PATENT APPLICATION

The present application is a continuation of U.S. application Ser. No. 16/521,329, filed Jul. 24, 2019, which is a continuation of International Application No. PCT/US2018/015351, filed Jan. 26, 2018, which claims the benefit and priority to U.S. Provisional Patent Application No. 62/451,217, filed Jan. 27, 2017, which are incorporated herein by reference in their entireties.

BACKGROUND OF THE INVENTION

The present invention relates to a wrench case, and particularly to a wrench case for combination wrenches.

SUMMARY

In one aspect, the invention provides a wrench case for a set of combination wrenches, where each wrench in the set of combination wrenches includes an open end, a closed end, and an elongate handle extending between the open end and the closed end. The wrench case includes a handle, a post that receives the open end of each wrench, a body including a front side and a back side opposite the front side. The front side supports the elongate handle of each wrench. The wrench case further includes a plurality of tabs spaced apart along the front side of the body. The plurality of tabs define gaps between adjacent tabs that receive each wrench. The wrench case further includes a door pivotally coupled to the body. The door is pivotable relative to the body between a closed position and an open position. The door is adjacent the front side of the body to maintain each wrench against the body in the closed position. Each wrench is allowed to be removed from the body in the open position.

In another aspect, the invention provides a wrench case for a set of combination wrenches, where each wrench in the set of combination wrenches includes an open end, a closed end, and an elongate handle extending between the open end and the closed end. The wrench case includes a handle, a post that receives the open end of each wrench, a body including a front side and a back side opposite the front side. The front side supports the elongate handle of each wrench. The wrench case further includes a door coupled to the body. The door is movable relative to the body between a closed position and an open position. The door is adjacent the front side of the body in the closed position. Each wrench is allowed to be removed from the body in the open position. The wrench case further includes a latch extending from the body. The latch is couplable to the door to maintain the door in the closed position. The door releases from the latch while pivoting from the closed position toward the open position in response to rotation of one of the wrenches about the post.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
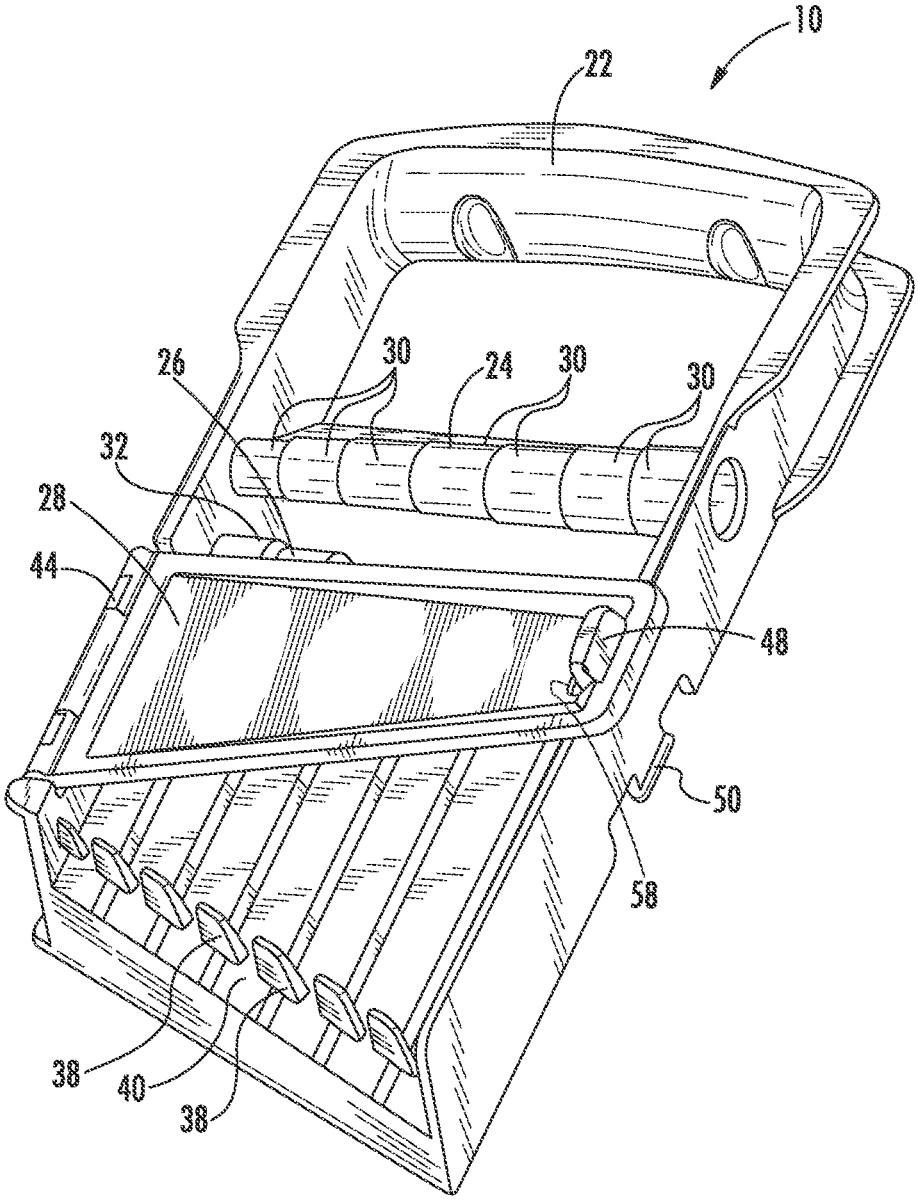
FIG. 1 is a perspective view of a wrench case according to an embodiment of the invention.
Figure 3:
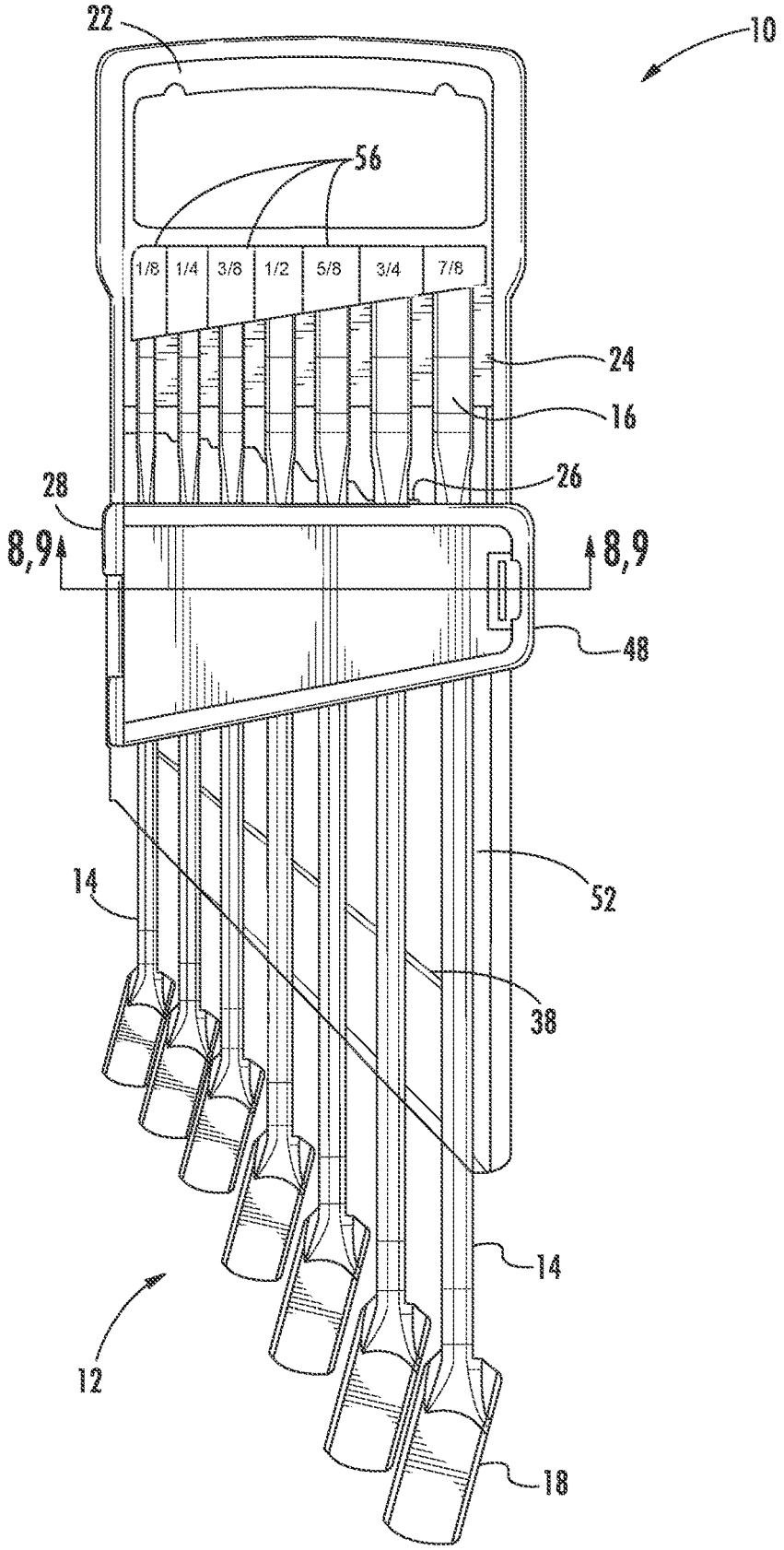
FIG. 3 is a front side view of the wrench case including wrenches.
Figure 4:
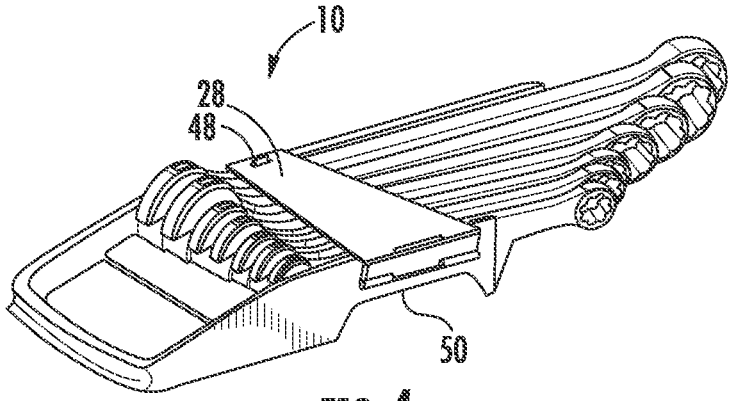
FIG. 4 is a perspective view of the wrench case with a door in a closed position.
Figure 5:
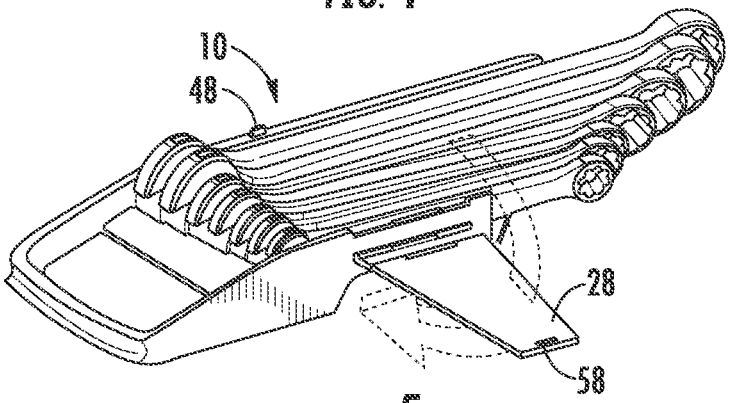
FIG. 5 is a perspective view of the wrench case with the door in a partially open position.
Figure 6:
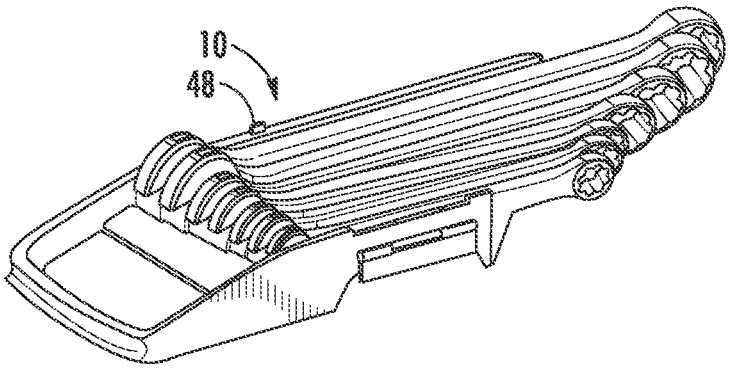
FIG. 6 is a perspective view of the wrench case with the door in a fully open position.

FIG. 1 illustrates a wrench case 10. The illustrated wrench case 10 is configured for storing and transporting a set of combination wrenches 12 (FIG. 3). The set of combination wrenches 12 includes individual combination wrenches 14 of different sizes (e.g., ¼", 5/16", ⅜", etc. for an SAE set or 8 mm, 10 mm, 11 mm, etc. for a metric set). The combination wrenches 14 each include an open end 16, a closed end 18, and an elongate handle 20 extending therebetween.

Figure 2:
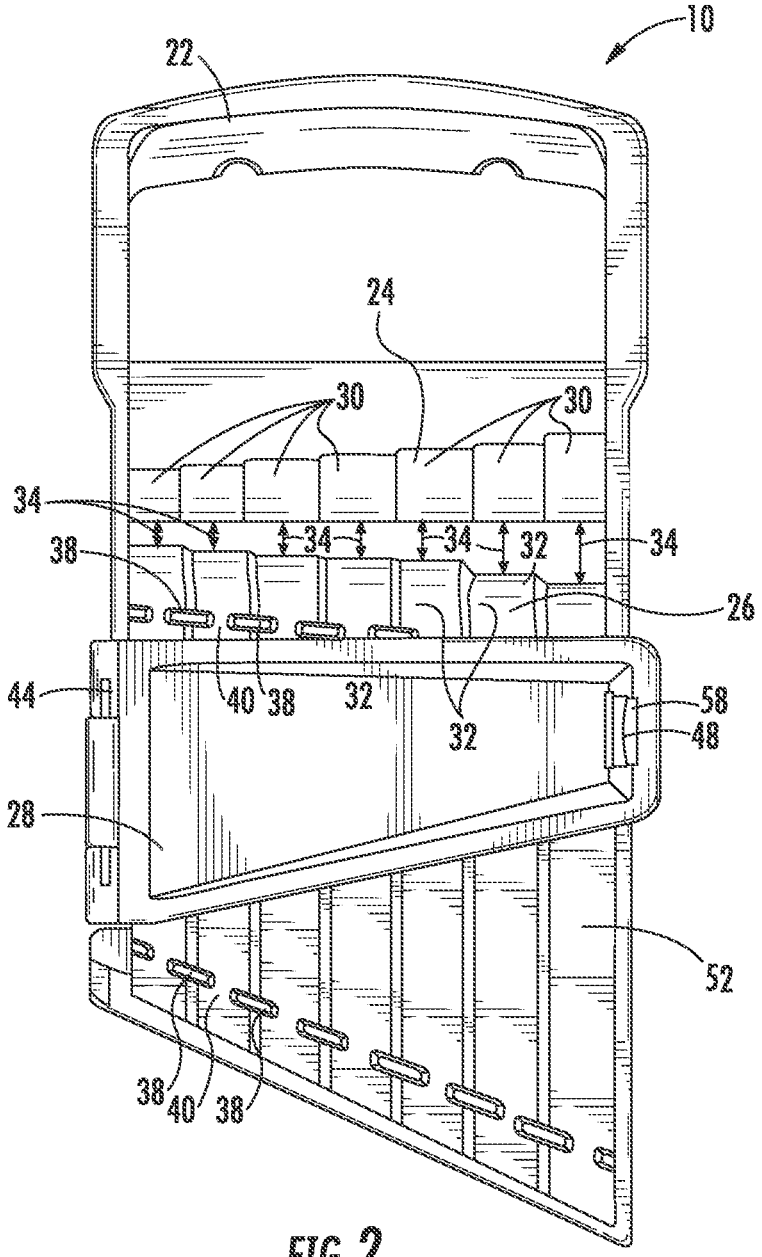
FIG. 2 is a front side view of the wrench case of FIG. 1.

Referring to FIGS. 1 and 2, the wrench case 10 includes a carrying handle 22, a post 24, a body portion 26, and a door 28. The post 24 includes stepped sections 30 each having a different outer dimension that corresponds to a size of one of the open ends 16 of one of the wrenches 14. Although the stepped sections 30 are circular, in other embodiments, the stepped sections 30 could alternatively be shaped different (i.e., square, hexagonal, octagonal, etc.). The body portion 26 includes steps 32 that define different distances 34 between the body portion 26 and the adjacent stepped section 30 of the post 24. The distances 34 increase as the outer dimension of the stepped sections 30 increase. The distances 34 are sized to receive and accommodate a jaw of the open end 16 of one of the wrenches 14. The body portion 26 further includes a front side 52, a back side 54 opposite the front side 52, and tabs 38 disposed on and extending away from the front side 52 of the body portion 26. The tabs 38 define gaps 40 disposed between adjacent tabs 38 for receiving the wrenches 14. Each gap 40 is disposed entirely on a corresponding step 32, such that none of the gaps 40 traverse from one step 32 to an adjacent step 32.

Figure 8:
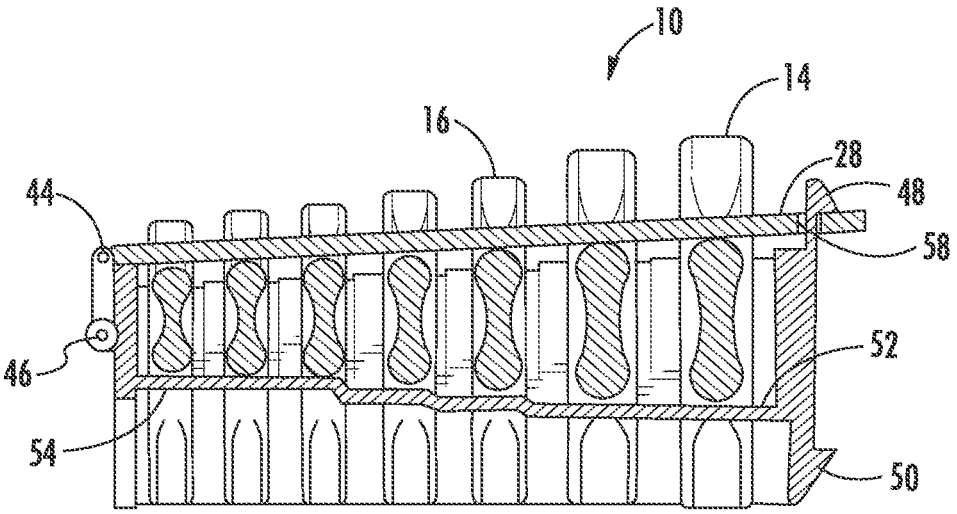
FIG. 8 is a cross-sectional view of the wrench case along line 8-8 of FIG. 3, illustrating the door in the closed position.
Figure 9:
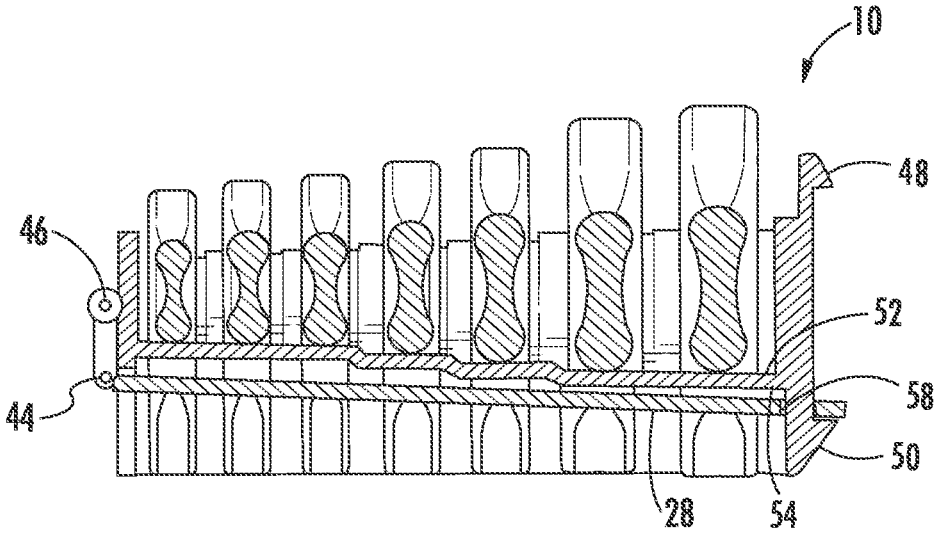
FIG. 9 is a cross-sectional view of the wrench case along line 9-9 of FIG. 3, illustrating the door in the fully open position.

Referring to FIGS. 1, 8, and 9, the door 28 includes a double hinge 42 having a first pivot 44 and a second pivot 46 that is parallel to the first pivot 44, meaning that the first and second pivot 44, 46 are offset from each other. The case 10 includes a front latch or hook 48 and a rear latch or hook 50. The front latch 48 retains the door 28 in a closed position via a slotted aperture 58 as illustrated in FIG. 1, whereas the rear latch 50 retains the door 28 in the fully open position via the slotted aperture 58 as illustrated in FIG. 9. The latches 48, 50 are elastically deformable to allow the user to latch and unlatch the door 28 from the latches 48, 50. The double hinge 42 (i.e., first pivot 44 and second pivot 46) allows the door to be substantially parallel to the front side 52 of the body portion 26 when the door 28 is in the closed position, while also allowing the door to be substantially parallel to the back side 54 of the body portion 26 when the door 28 is in the fully open position as illustrated in FIG. 9. That is, the double hinge 42 allows the door 28 to pivot approximately 180 degrees away from the closed position via the first pivot 44, while the second pivot 46 allows the door 28 to pivot an additional 180 degrees approximately toward the fully closed position. As such, the double hinge 42 allows the door 28 to pivot a full 360 degrees approximately. By approximately, the door 28 is capable of pivoting 360 degrees±10 degrees as a result of the double hinge 42.

Figure 7:
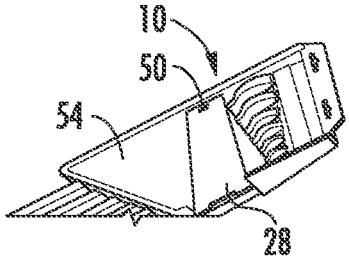
FIG. 7 is a rear perspective view of the wrench case with the door in the fully open position.

In operation, to remove one of the wrenches 14 from the case 10, the user lifts on the wrench 14 adjacent the closed end 18 of the wrench 14 to pivot the wrench 14 about the post 24 and away from the body portion 26 of the case 10. By pivoting the wrench 14, an upward force is exerted on the door 28. The door 28 opens when the force exerted on the door 28 via the wrench 14 is sufficient to elastically deform, for example, the latch 48. Thus, the wrench 14 is capable of automatically unlatching the door 28 from the front latch 48 as the wrench 14 pivots about the post 24, causing the door 28 to pivot about the first pivot 44. The user removes the wrench 14 by pulling the wrench 14 out of the case 10 and off of the post 24. The user can alternatively pull the door 28 will a sufficient force to elastically deform the latch 48 until the door 28 opens. If desired, the user can pivot the door 28 about the second pivot 46 and latch the door 28 on the rear latch 50 as shown in FIGS. 7 and 9. In this position, the door 28 lays flat along the back side 54 of the case 10, which is particularly useful for setting the case 10 down (e.g., on a bench, in a toolbox, etc.).

When the user is finished using the wrench 14, the user places the wrench 14 in the case 10 so that the corresponding stepped section 30 of the post 24 is received in the open end 16 of the wrench 14. The wrench 14 is then pivoted downward toward the body 26 until the wrench 14 is received in the gaps 40 between tabs 38 and supported on the body portion 26. Referring to FIG. 3, the illustrated case 10 includes indicia 56 (e.g., size markings) to indicate to the user the position along the post 24 where each corresponding wrench 14 is sized to fit. To transport the case 10 and set of wrenches 12, the user unlatches the door 28 from the rear latch 50 and closes the door 28 by latching the door 28 on the front latch 48. The door 28 and the body 26 support the open end 16 of the wrench 14 to prevent the wrenches 14 from sliding out of the case 10 under gravity when the case 10 is carried by the carrying handle 22.

Various features and advantages of the invention are set forth in the following claims.

What is claimed is:

1. A wrench case for a set of combination wrenches, where each wrench in the set of combination wrenches includes an open end, a closed end, and an elongate handle extending between the open end and the closed end, the wrench case comprising:

a handle;

a post that receives the open end of each wrench;

a body including a front side and a back side opposite the front side, the front side supporting the elongate handle of each wrench;

a plurality of tabs disposed on and extending away from the front side of the body, the plurality of tabs defining gaps between adjacent tabs that receive each wrench; and a door pivotally coupled to the body, the door pivotable relative to the body between a closed position and an open position, wherein the door is adjacent the front side of the body in the closed position, and wherein the door is adjacent to the back side of the body in the open position;

wherein the door includes a slot positioned to receive a first hook in the closed position, the first hook extending away from the front side of the body; and wherein the slot is also positioned to receive a second hook in the open position, the second hook extending away from the back side of the body.

2. The wrench of claim 1, wherein rotating one of the wrenches about the post creates a sufficient force on the door to elastically deform the first hook, causing the first hook to unlatch from the slot of the door.

3. The wrench case of claim 1, wherein the handle includes a front side wall and back side wall, the front side wall extending away from the front side of the body in a generally perpendicular direction and the back side wall extending away from the back side of the body in a generally perpendicular direction, and wherein the front side wall and back side wall together define a channel.

4. The wrench case of claim 1, wherein the post includes a plurality of stepped sections, wherein each stepped section has a shape.

5. The wrench case of claim 4, wherein the shapes of each stepped section are circular.

6. The wrench case of claim 4, wherein each stepped section has an outer dimension corresponding to a size of one of the open ends of one of the wrenches.

7. The wrench of claim 4, wherein the body includes a plurality of steps corresponding to the plurality of stepped sections of the post and wherein the plurality of steps define different distances between the body and the stepped sections of the post.

8. The wrench of claim 7, wherein the distance between the body and the stepped section of the post increases as the outer dimension of the stepped section of the post increases.

9. The wrench of claim 8, wherein the distance is sized to receive a jaw of the open end of one of the wrenches.

10. The wrench of claim 7, wherein the gaps between the tabs are disposed entirely on a corresponding step of the body, such that none of the gaps traverse from one step to an adjacent step of the body.

11. The wrench case of claim 1, further including a hinge to pivotally coupling the door to the body.

12. The wrench case of claim 11, wherein the hinge includes a first pivot and a second pivot spaced apart such that the second pivot is offset from the first pivot, wherein the door simultaneously rotates about the first pivot and the second pivot when pivoting between the closed position and the open position.

13. A wrench case for a set of combination wrenches, where each wrench in the set of combination wrenches includes an open end, a closed end, and an elongate handle extending between the open end and the closed end, the wrench case comprising:

a handle;

a post;

a body including a front side and a back side opposite the front side;

a door coupled to the body, the door movable relative to the body between a closed position and an open position, wherein the door is adjacent the front side of the body in the closed position, and wherein the door is adjacent to the back side of the body in the open position; and a latch structure extending from the body, wherein the latch structure is positioned to engage the door to maintain the door in the closed position, wherein the latch structure is a first hook extending away from the front side of the body, and further comprising a second hook extending away from the back side of the body, wherein the door is coupled to the first hook when the door is in the closed position, and wherein the door is coupled to the second hook when the door is in the open position;

wherein the door releases from the latch structure while pivoting from the closed position toward the open position in response to rotation of one of the wrenches about the post; and wherein the door includes a slot positioned to receive the first hook in the closed position and positioned to receive the second hook in the open position.

14. The wrench case of claim 13, wherein the door is held in the open position until a sufficient force is exerted on the door to elastically deform the second hook, causing the second hook to unseat from the slot of the door.

15. The wrench case of claim 13, further including a hinge, the hinge including a first pivot and a second pivot that is parallel and offset to the first pivot, wherein the door simultaneously rotates about the first pivot and the second pivot when pivoting between the closed position and the open position.

16. The wrench case of claim 13, the body further including indicia to specify a position along the post each corresponding wrench is sized to fit.

17. A wrench case for a set of combination wrenches, where each wrench in the set of combination wrenches includes an open end, a closed end, and an elongate handle extending between the open end and the closed end, the wrench case comprising:

a handle;

a post that receives the open end of each wrench;

a body including a front side and a back side opposite the front side, the front side supporting the elongate handle of each wrench;

a plurality of tabs disposed on and extending away from the front side of the body, the plurality of tabs defining gaps between adjacent tabs that receive each wrench; and a door pivotally coupled to the body, the door pivotable relative to the body between a closed position and an open position, wherein the door is adjacent the front side of the body in the closed position, and wherein the door is adjacent to the back side of the body in the open position, wherein the door has a thickness less than a diameter of the elongated handle of each wrench;

a first hook extending away from the front side of the body;

a second hook extending away from the back side of the body; and a slot that extends through the thickness of the door such that the slot receives the first hook in the closed position and receives the second hook in the open position.

18. The wrench case of claim 17, further comprising a hinge pivotally coupling the door to the body, the hinge including a first pivot and a second pivot that is parallel to and offset from the first pivot, each pivot defining a pivot axis, wherein the door includes a height dimension parallel to the pivot axes that is less than a length of the elongated handle of each wrench.

* * * * *